US005522091A

United States Patent [19]

Rudolf

[11] Patent Number: 5,522,091

[45] Date of Patent: Jun. 4, 1996

[54] SIGHTER'S PROTECTIVE HELMET

[75] Inventor: Charles G. Rudolf, Dalton, Pa.

[73] Assignee: Gentex Corporation, Carbondale, Pa.

[21] Appl. No.: 210,916

[22] Filed: Mar. 21, 1994

[51] Int. Cl.[6] ..... A42B 3/00

[52] U.S. Cl. ..... 2/6.2; 2/6.6; 2/414

[58] Field of Search ..... 2/410, 411, 414, 2/421, 422, 423, 425, 6.1, 6.2, 6.6, 205

[56] References Cited

U.S. PATENT DOCUMENTS

| | | | |
|---|---|---|---|
| 2,871,484 | 2/1959 | Finken et al. | 2/6.2 |
| 3,786,519 | 1/1974 | Aileo | 2/6 |
| 3,906,547 | 9/1975 | Aileo | 2/6.2 |
| 4,023,209 | 2/1976 | Frieder et al. | 2/6 |
| 4,748,694 | 6/1988 | Aileo | 2/423 |

FOREIGN PATENT DOCUMENTS

| | | | |
|---|---|---|---|
| 281414 | 6/1956 | Switzerland | 2/6.1 |
| 212187 | 3/1924 | United Kingdom | 2/6.1 |

*Primary Examiner*—Michael A. Neas
*Attorney, Agent, or Firm*—Shenier & O'Connor

[57] ABSTRACT

A protective headgear assembly for use by personnel required to use sighting devices in which a close-fitting helmet carries impact-resistant, energy-absorbing material over that portion covering the wearer's nape, crown and side head portions over the ears but which is free of such material in the frontal portion which covers the wearer's forehead to permit the wearer to bring his eye into close proximity with a sighting device. A separable body of impact-resisant, energy-absorbing material is removably positioned over the helmet frontal portion by detachable fasteners which secure the body to a soft cover on the helmet where the wearer desires only bump protection or by a separable part of a two-part ballistic shell attached to the helmet where the wearer desires both bump and ballistic protection. The helmet can be adapted for use by non-sighter personnel by using either a unitary soft cover or a unitary ballistic shell to position the separable body on the helmet.

16 Claims, 7 Drawing Sheets

SIGHTER'S PROTECTIVE HELMET

FIELD OF THE INVENTION

The invention is in the field of protective helmets and more particularly relates to a protective helmet for use by personnel required to use sighting devices.

BACKGROUND OF THE INVENTION

There are known in the prior art protective helmets especially adapted for use by military personnel. Certain helmets of the prior art are intended to protect the head of the wearer against injury resulting from bumps and the like such as might be encountered by personnel in a tank. Ballistic helmets of the prior art are intended to protect the head of the wearer against injury resulting from missiles and the like. Many helmets of the prior art combine protection against injury resulting from bumps and the like with protection against injury from ballistic missiles. U.S. Pat. No. 3,786,519 discloses a headgear structure or helmet assembly which combines bump protection with ballistic protection.

Many military users of protective helmets must use sighting devices which require that the user's eye or eyes be brought into relatively close proximity to the sighting device. The construction of most protective helmets of the prior art is such that the wearer's eye cannot be brought into close proximity to a sighting device while the helmet is on the wearer's head. Thus, in order to effectively use the sighting device, the wearer must doff the helmet and sacrifice the protection afforded thereby.

Structurally, the helmet shown in U.S. Pat. No. 3,786,519 includes a flexible inner helmet and a rigid outer assembly. The inner assembly is made up of a fabric envelope which fits closely over the wearer's head. It has a plurality of pockets for receiving pads of bump-resistant impact-absorbing material. These pockets include one which extends across the forehead of the wearer and which receives an insert of bump-resistant impact-absorbing material. This inner flexible helmet affords the wearer's head protection against injury from bumps and the like. The rigid outer shell of the helmet assembly shown in the patent discussed above, is formed as a unitary body covering the forehead crown and nape portions of the inner helmet. It affords the wearer ballistic protection while the inner helmet affords protection against bumps.

U.S. Pat. No. 4,023,209 represents an attempt to adapt the helmet structure shown in the '519 patent to the needs of a sighter or one who must use a sighting device such as a gunsight. In the construction shown in the '209 patent the forehead pocket of the inner helmet carries an insert which gives the wearer ballistic protection in the forehead region. The rigid outer shell includes a rear portion covering the nape and crown portions of the inner helmet and so constructed as to afford ballistic protection in these regions in addition to the bump protection afforded by that portion of the inner helmet which is covered by the rear portion of the outer shell. The outer shell includes a separate forehead piece which is detachably secured over the forehead portion of the inner helmet by VELCRO fasteners or the like. This removable piece serves only to distribute forces applied thereto over the ballistic pad carried by the forehead pocket of the inner helmet.

While the construction of the helmet shown in the '209 patent represents an attempt to solve the problem of fully protecting a sighter's head against injury, it is not entirely satisfactory. First, owing to the presence of the frontal ballistic pad in the inner helmet structure, a sighter cannot bring his eye as close as is desirable to the sighting device even with the forehead portion of the outer shell removed. Secondly, owing to the fact that ballistic material has been substituted for the bump resistant material in the frontal portion of the inner helmet, the wearer is not afforded the degree of protection against bumps which is desirable. Thirdly, the removable forehead portion of the outer shell is not accurately located on the inner shell even when in place and may easily become dislodged therefrom.

SUMMARY OF THE INVENTION

One object of my invention is to provide a protective helmet assembly which is especially adapted for use by sighters.

Another object of my invention is to provide a helmet assembly which protects a sighter's head against injury from bumps or both bumps and ballistic objects.

A further object of my invention is to provide a sighter's protective helmet which is so constructed as to permit a sighter to position his eye close to the sighting device without sacrificing all of the protection afforded by the helmet.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
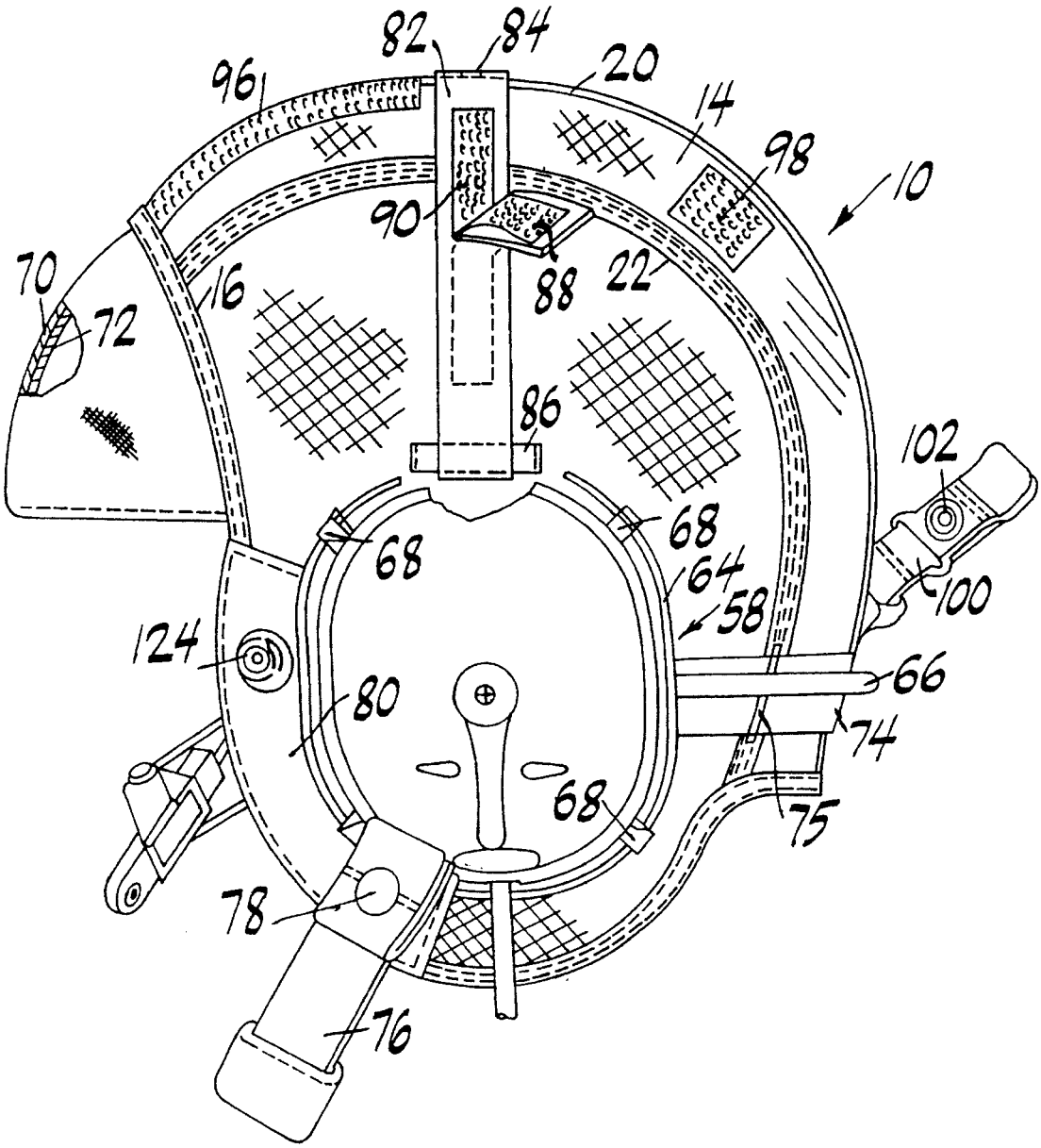
FIG. 1 is a side elevation of the flexible inner helmet component of my sighter's helmet assembly.
Figure 2:
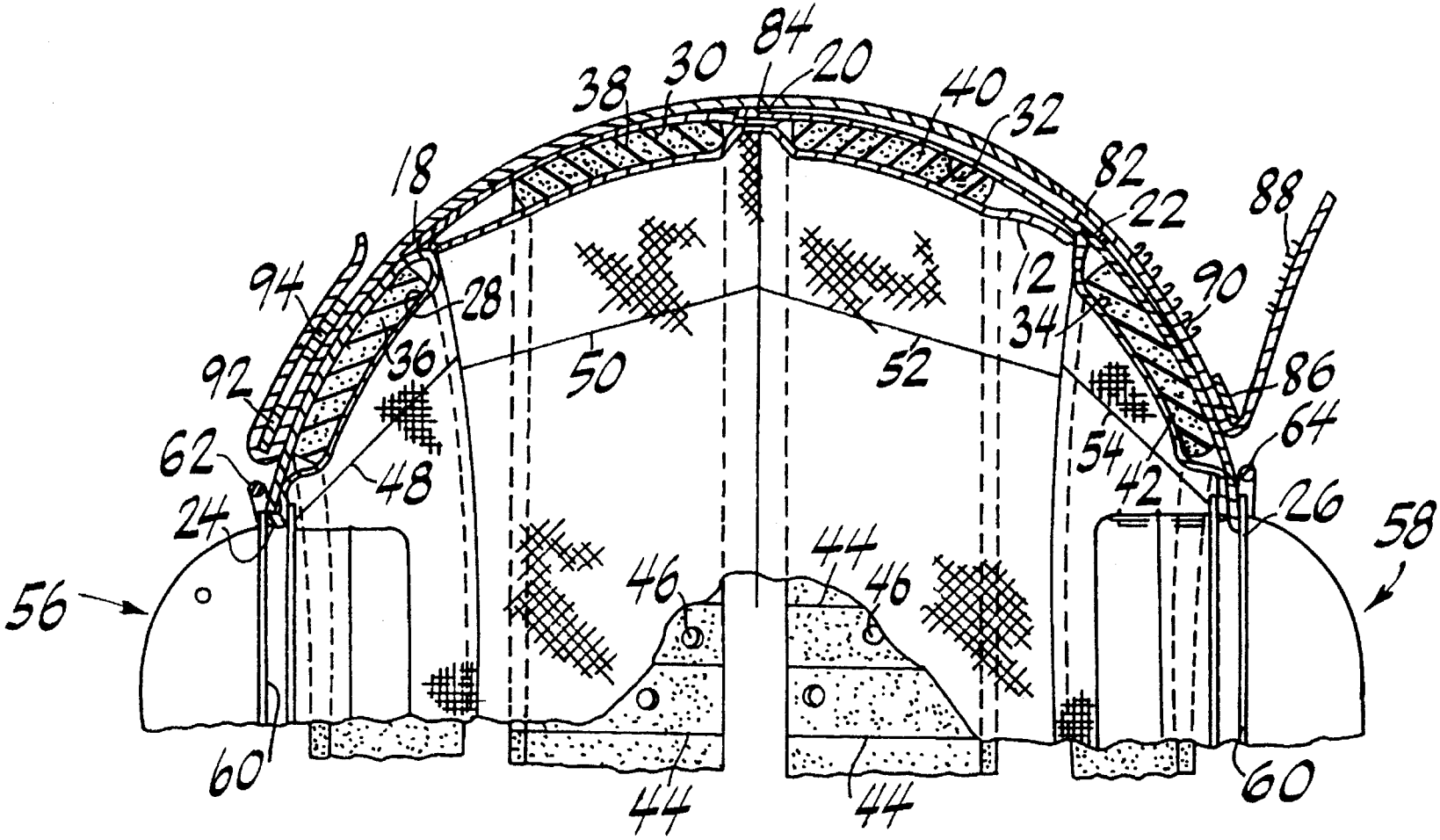
FIG. 2 is a fragmentary sectional view of the inner helmet illustrated in FIG. 1.

Referring now to FIGS. 1 and 2, the common inner helmet component indicated generally by the reference character 10 of my sighter's protective helmet assembly includes inner and outer flexible relatively yieldable netting covers 12 and 14. These covers 12 and 14 may be formed of any suitable material such, for example, as nylon mesh to aid in ventilating the head of the wearer.

The inner and outer covers 12 and 14 are secured to each other at the mating edges thereof by a tape 16 which is folded over the edges and stitched. A central tape 20 and side tapes 18 and 22 extend over the outer mesh cover 14 from front to back of the inner helmet 10 and are stitched to the inner and outer covers 12 and 14 to form pockets in the manner described hereinbelow.

The inner helmet 10 also is formed with respective right and left earcup assembly receiving openings 24 and 26. This may be done in the manner shown in the '519 patent referred to hereinabove.

Owing to the construction just described, the inner and outer covers 12 and 14 form mesh fabric envelopes or pockets 28, 30, 32 and 34. The central envelopes 30 and 32 extend from a location adjacent to the top of the wearer's forehead to the rear of the helmet 10. The side envelopes or pockets 28 and 34 extend from locations at the sides of the wearer's forehead over the earcup assembly openings toward the back of the helmet 10.

The inner cover 12 is formed with respective slits 48, 50, 52 and 54 to facilitate insertion of respective bodies 36, 38, 40 and 42 into the pockets or envelopes 28, 30, 32 and 34. The bodies 36, 38, 40 and 42 are formed of any suitable energy-absorbing impact resistant material such, for example, as a slowly resilient expanded vinyl. They are skived at 44 to permit them better to conform to the shape of the wearer's head. Holes 46 facilitate ventilation.

The earcup assembly openings 24 and 26 receive respective earcup assemblies indicated generally by the reference characters 56 and 58. While the details of the earcup assemblies 56 and 58 per se from no part of my invention, they may, for example, be of the type shown in '209 referred to hereinabove.

The hard outer shell of each of the earcup assemblies 56 and 58 is formed with a channel 60. An earcup assembly biasing system includes respective wire loops 62 and 64 which extend around the outside of the channels 60 of the assemblies 56 and 58. The loops 62 and 64 are formed from a single length of wire, the ends of which are joined within a tubular member 66 which extends across the back of the helmet. Each of the loops 62 and 64 carries a plurality of tabs 68 at spaced locations therearound. The tabs 68 extend into the channel 60 of the associated earcup assembly 56 or 58. The wire form just described biases the respective earcup assemblies 56 and 58 toward the wearer's ear to form an effective seal therewith. The construction and arrangement of this spring wire biasing device is more fully described in U.S. Pat. No. 4,748,694.

From the structure thus far described, it will be seen that the tape 16 extends over the sides and upper region of the wearer's forehead. The inner helmet 10 includes a pair of crescent-shaped overlying fabric pieces 70 and 72 which are stitched to the tape 16 in the forehead portion thereof and to each other at the lower edges thereof. It will be appreciated that the pieces 70 and 72 have very little aggregate thickness as compared with a forehead envelope containing a bump resistant insert so that a sighter wearing the inner helmet 10 may bring his eye into very close relationship to the sighting device. It may be desirable to add a thin foam rubber layer (not shown) between the two fabric pieces 70 and 72.

The inner helmet 10 includes a nape strap 74, one end of which is secured to the helmet adjacent to one of the earcup openings 24 and 26. The other free end passes through respective loops 75 on the tapes 20 and 22 and through another loop adjacent to the other earcup assembly opening. The free end then may be doubled back and adjustably secured to the length of the strap 74 by means of a hook and loop fastener, for example (not shown).

An adjustable chinstrap 76 is secured by snaps 78, one of which is shown in FIG. 1, to complementary fasteners on leather pieces 80 secured to the helmet 10 in front of the earcup openings 24 and 26.

The helmet 10 also includes a top or crown strap 82, the center of which is stitched at 84 to the tape 20. The left free end of the crown strap 82 extends through a left loop 86 secured to the helmet 10 above the ear opening 26. This end of the crown strap 82 carries loop fastener elements 88 adapted to be brought into engagement with hook fastener elements 90 on the crown strap adjustably to secure the left end of the crown strap to the loop 86.

The right end of the crown strap 82 extends through a loop 92 formed above the ear opening 24. When the right end of the crown strap 82 is folded back on the strap, loop and hook fastener elements indicated by the reference character 94 may be brought into operative engagement with each other adjustably to secure the right end of the strap to the loop 92.

The crown strap structure just described, together with the nape strap enables the inner helmet 10 to be brought into close conformity to the wearer's head. As a result, one size helmet may be made to fit all wearers. The crown strip 82 also aligns the earcup assemblies 56 and 58 directly over the wearer's ears and keeps them from sagging with time.

For reasons which will be described more fully hereinbelow, the helmet 10 may carry a centrally located front pad 96 of hook and loop fastener elements and respective side central pads 98 of fastener elements located just to the rear of the crown portion of the helmet.

An adjustable outer helmet retaining strap 100 secured to the rear of the helmet 10 carries a female snap fastener element 102.

Figure 3:
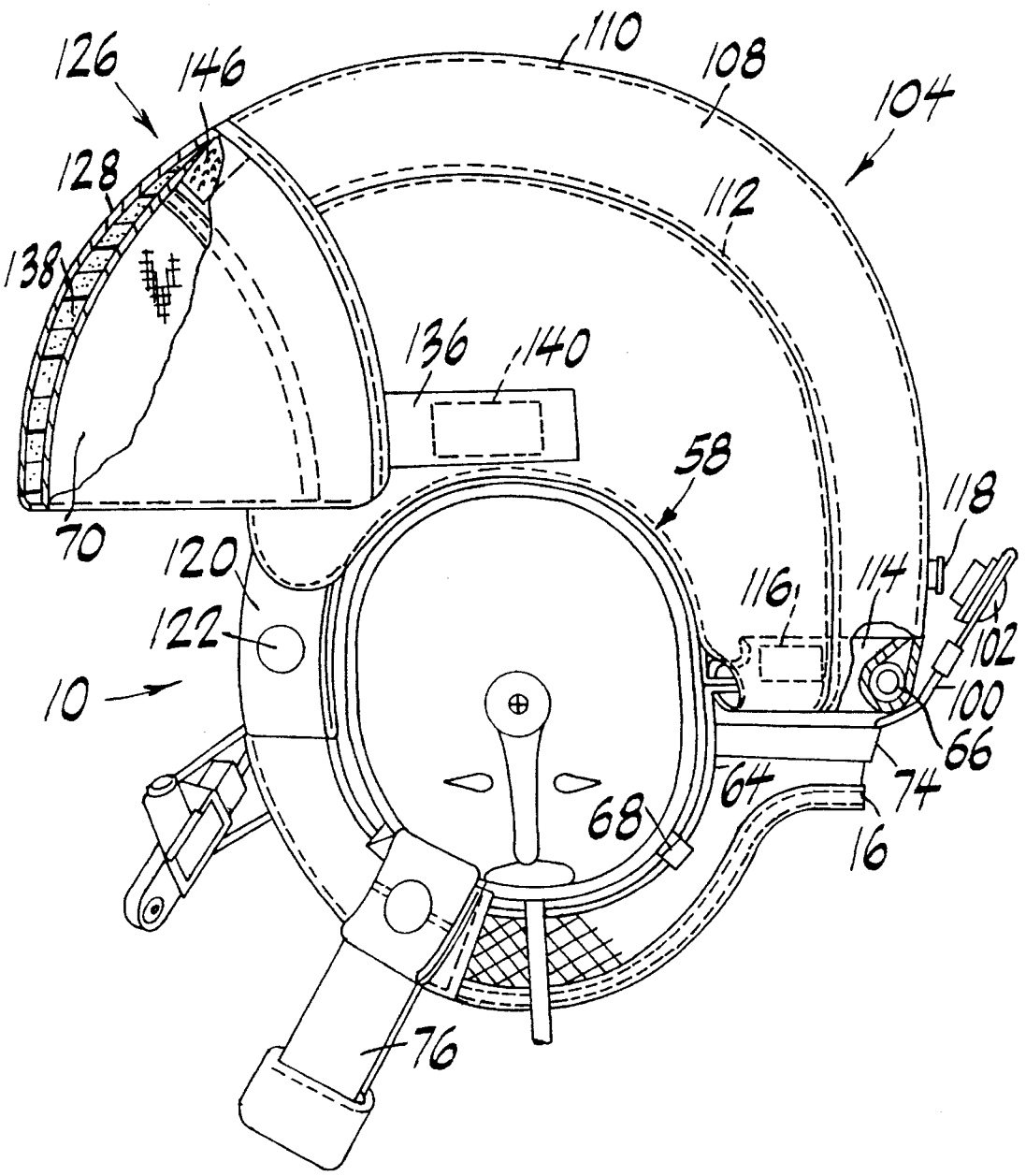
FIG. 3 is a side elevation of one completed embodiment of my sighter's helmet assembly.
Figure 4:
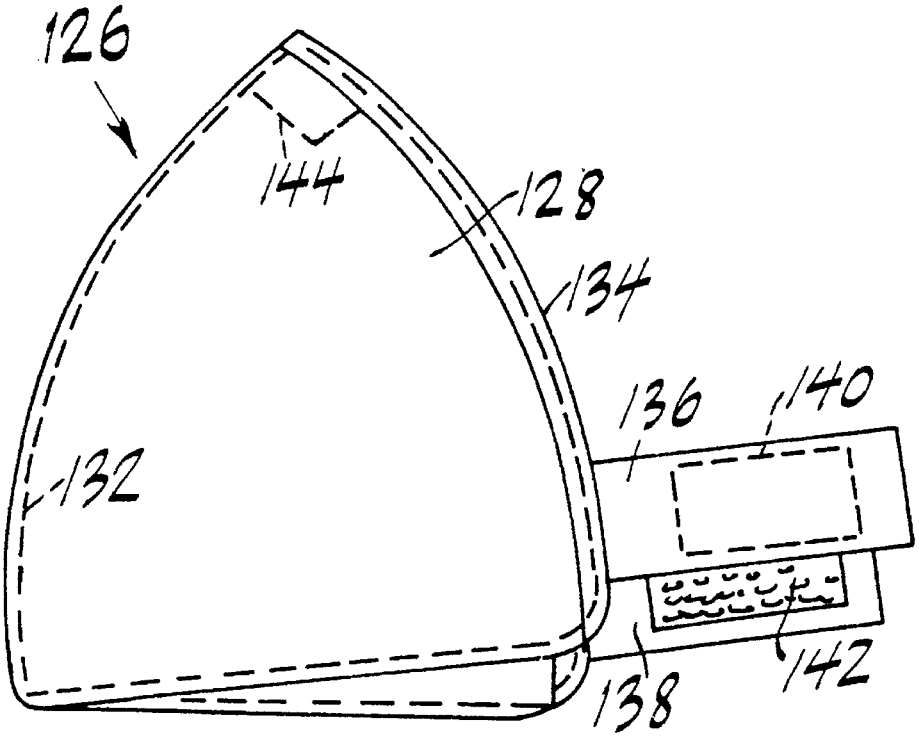
FIG. 4 is a side elevation of the removable bump protection piece of the form of my sighter's helmet assembly illustrated in FIG. 3.

Referring now to FIGS. 3 and 4, the first embodiment of my sighter's protective helmet is completed by assembling an outer cover indicated generally by the reference character 104 over the inner helmet 10. The outer cover 104 includes a pair of side panels 106 and a pair of crown panels 108, one of each of which is shown in FIG. 3. The two crown panels are connected by stitching 110. Stitching 112 secures each of the side panels 106 to its associated crown panel 108. The panels 106 and 108 may be formed of any suitable material such for example as glove leather.

I form the outer cover 104 with a rear flap 114. This flap 114 is adapted to be doubled up inwardly over the member 66 when the outer cover 104 has been assembled on the inner helmet 10. Respective pads 116 of hook and loop fasteners are adapted to retain the doubled up flap 114 in position around the member 66.

The rear central portion of the outer cover 104 is provided with a male snap fastener element 118 adapted to be engaged by the snap fastener element 102.

I stitch, or otherwise secure, a pair of short lengths of webbing 120, one of which is shown in FIG. 3, to the cover 104 in front of the earcup assemblies 56 and 58. When the cover 104 is placed on the inner helmet 10, snap fastener elements 122 carried by the webbing 120 are snapped onto complementary elements 124 carried by the leather pieces 80 on the inner helmet 10. In this manner the outer cover 104 is securely held in position on the inner helmet 10.

I provide the first embodiment of my sighter's protective helmet with a removable piece indicated generally by the reference character 126 adapted to be assembled on the outer cover 104 over the forehead of the wearer to protect that portion of the wearer's head against injury from bumps.

The removal piece 126 is made up of a leather envelope 128 which receives an insert 130 of bump protecting material which may, for example, be of the same material as that of which the bodies 36, 38, 40 and 42 are formed. The inner and outer leather pieces forming the envelope or pocket 128 are stitched together at the bottom and connected at the top by a tape 134 which is folded over the upper edges of the leather pieces and stitched.

I secure a pair of rearwardly extending webbing tabs 136 and 138 to the sides of the removable piece 126. The inside of the tab 136, for example, carries a pad 140 of fastener elements which cooperate with complementary elements of a pad secured to the cover 104 over the earcup assembly 58. Similarly, the tab 138 that carries a pad 142 of fastener elements which cooperate with complementary elements carried by a pad (not shown) on the cover 104 over the earcup assembly 56. I provide the upper central region of the removable piece 126 with a pad 144 of hook and loop fastener elements for cooperation with complementary elements carried by a pad 146 at the front center of the cover 104.

When the individual wearing the first form of my sighter's protective helmet is to use a sighting device, the piece 126 is removed from the cover 104 by disengaging the fastener elements on pads 140, 142 and 144 from the complementary elements on the cover 104. When this has been done the fabric layer 70 is exposed and the wearer can bring his eye into close proximity with the sighting device.

It is to be noted that the upper edge of the insert 130 in removable piece 126 is tapered and that it overlies the forward edges of the bodies 36, 38, 40 and 42 which also are tapered. In this manner, when the piece 126 is assembled on the cover 104 there is no interruption in the bump protection between that afforded by piece 126 and by the inner helmet 10.

Figure 5:
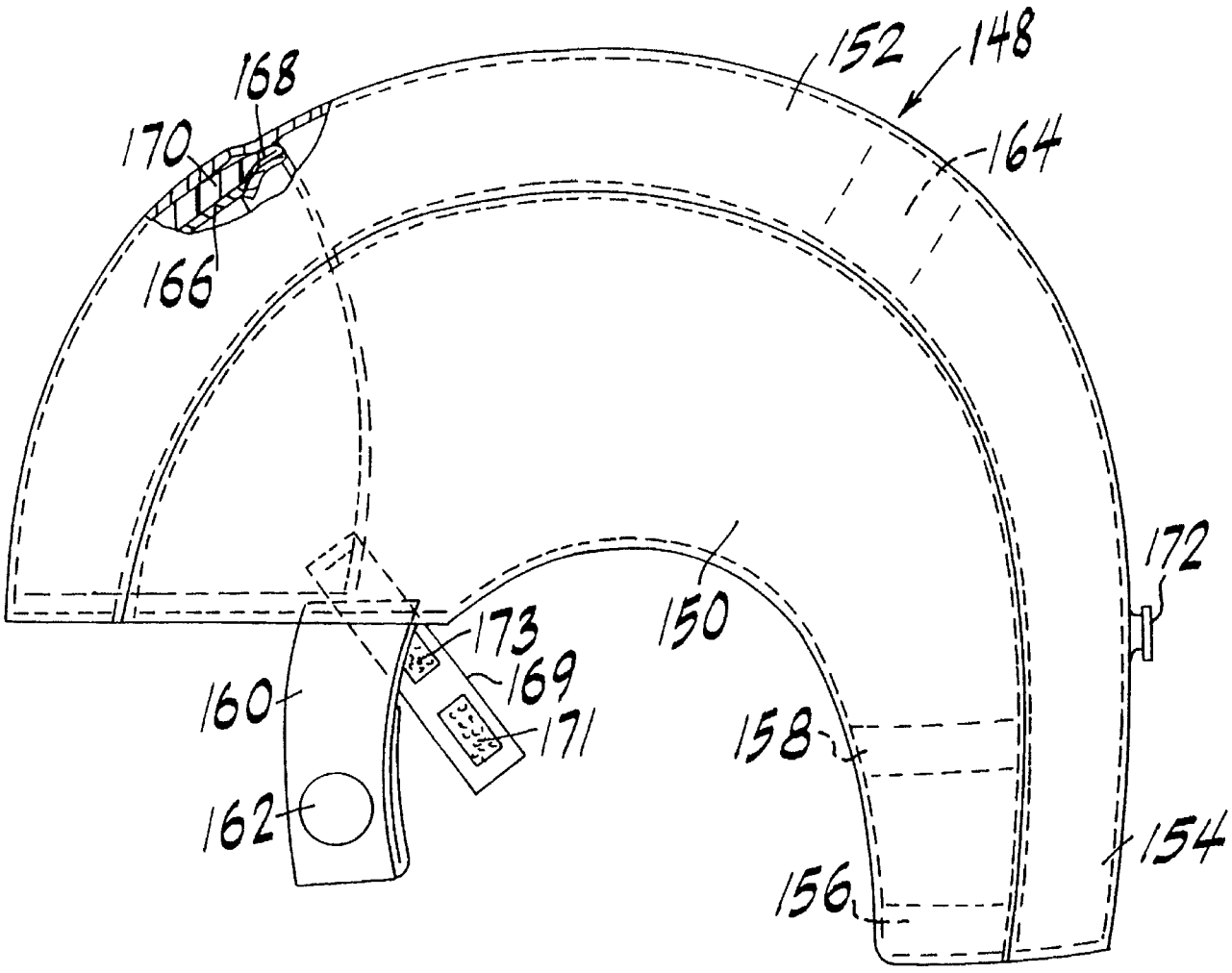
FIG. 5 is a side elevation of a component of a second embodiment of my sighter's helmet assembly.
Figure 5A:
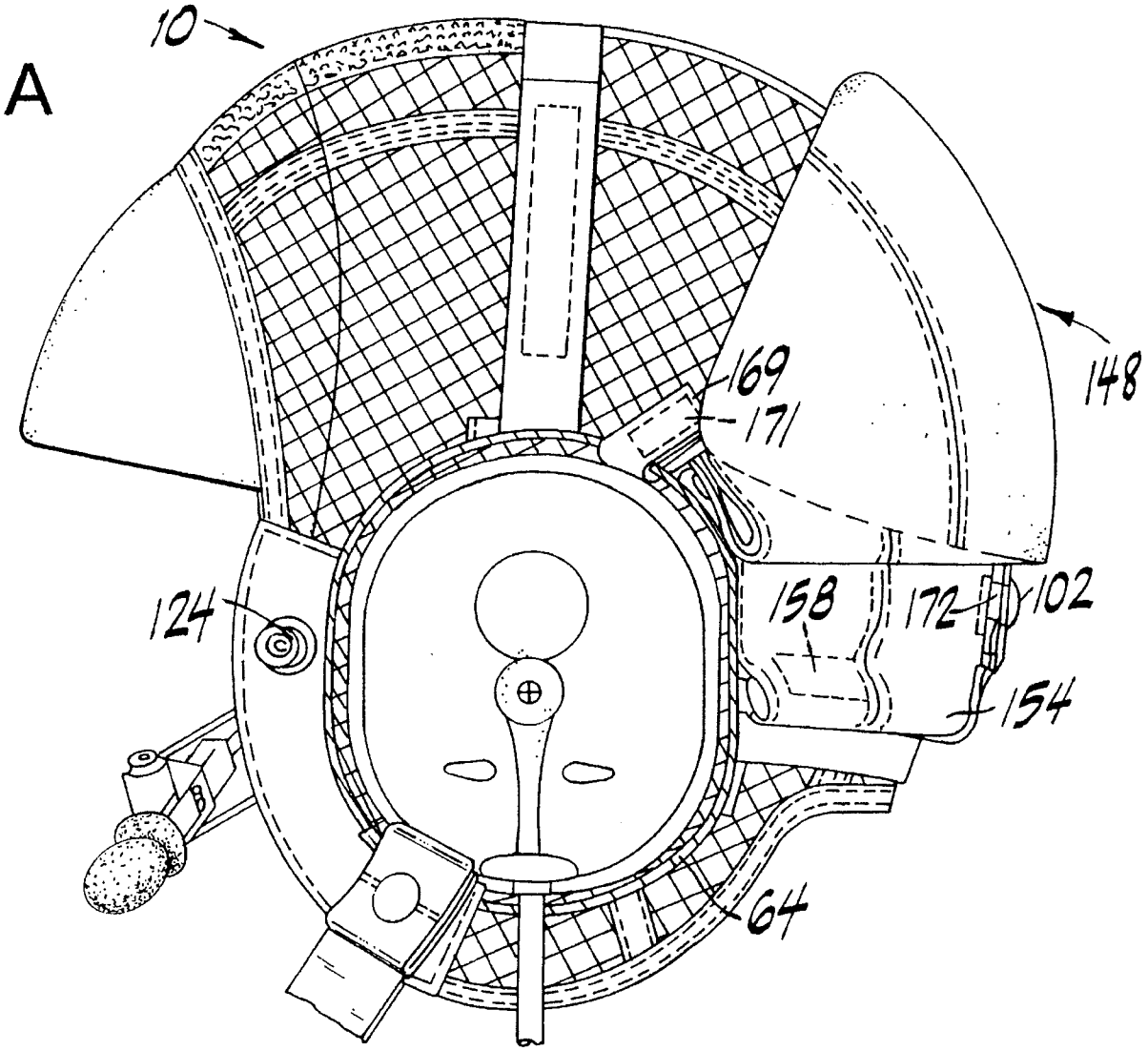
FIG. 5A is a side elevation of the second embodiment of my sighter's helmet assembly with the brow protective portion in the stowed position.

Referring now to FIGS. 5 and 5A, I have shown an outer cover indicated generally by the reference character 148, adapted to be assembled onto the inner helmet 10 so as to make up the second embodiment of my protective helmet. The cover 148 is made up of a pair of side panels 150, one of which is shown, and a pair of crown panels 152 which are stitched together in the same manner as panels 106 and 108 of the cover 104. Panels 150 and 152 may also be formed of glove leather. These panels 150 and 152, however, extend over the forehead portion of the wearer which is covered by fabric piece 70 and rearwardly over the crown and back part of the inner helmet 10 above the earcup assemblies 56 and 58. I provide the cover 148 with a flap or extension 154 adapted to be wrapped around the member 66 and secured to itself by means of hook and loop fastener elements on pads 156 and 158.

Respective webbing lengths 160, one of which is shown, carry snap fastener elements 162 adapted to be brought into engagement with the complementary fastener elements 124 on the inner helmet 10 to hold the cover 148 in position. A fabric piece 166 stitched to the inside of the cover 148 along its front edge and to a tape 168 running along the inner edge thereof, forms a pocket for receiving a body 170 of impact resisting bump absorbing material 170 similar to the material of which the body 130 is formed. As is the case with the body 130, I taper the upper edge of the body 166 so as to overlie the front edges of the bodies 36, 38, 40 and 42 to afford full protection to the wearer.

A male fastener element 172 secured to the back of the outside of the cover 148 is adapted to receive the snap fastener element 102 carried by the webbing length 100 on the inner helmet 10.

I provide the second embodiment of my sighter's protective helmet with means for retaining the portion of the cover 148 containing piece 170 in an inoperative position when the wearer is using a sighting device. I stick or otherwise attach one end of each of a pair of elastic straps 169, one of which is shown in FIGS. 5 and 5A to the fabric piece 166 at the lower rear sides thereof. The other ends of the elastic straps 169 are passed around the respective wires 62 and 64 and secured back along the lengths of the straps 169 by means of pads of interengageable fasteners 171 and 173 of the hook and loop type.

When a person wearing the second form of my sighter's protective helmet has occasion to use a sighting device, the two tabs 160 first are detached from the elements 124. The front brow portion of the cover 148 containing the insert 170 is lifted slightly off the inner helmet 10 and pushed to the back of the inner helmet to the position shown in FIG. 5A. In the course of this movement, the elastic straps 169 slide along the respective wires 62 and 64. The elastic straps 169 retain the cover 148 in the position shown in FIG. 5A until it is returned to the position shown in FIG. 5 by reversing the procedure just described.

The forms of my sighter's protective helmet thus far described are designed to protect the wearer's head against injury resulting from bumps and the like such as might be encountered by armored vehicle or tank crewmen or the like. It may, of course, be desirable that the wearer be protected against injury from ballistic objects.

Figure 6:
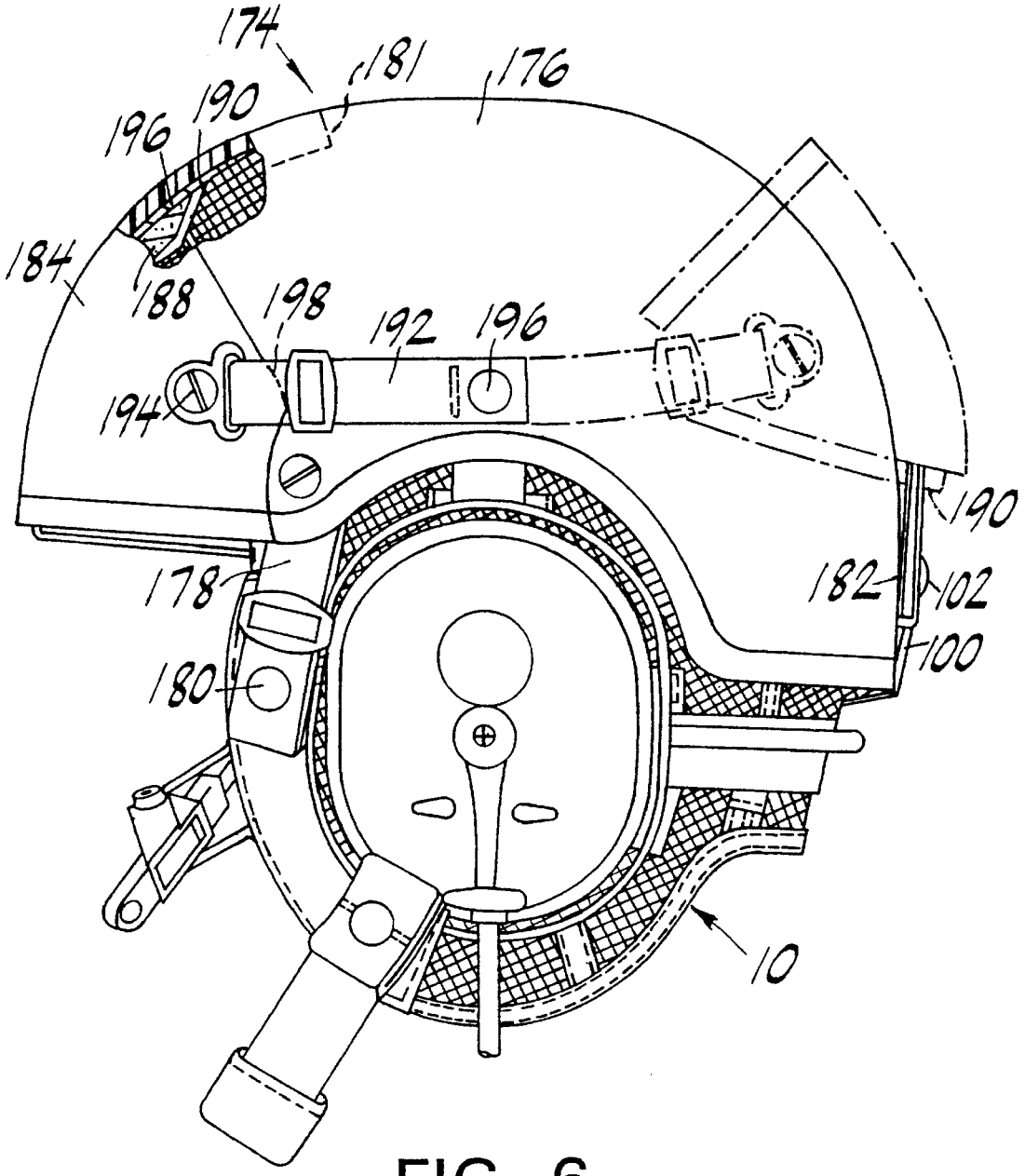
FIG. 6 is a side elevation of a complete assembly of a third embodiment of my sighter's protective helmet with parts broken away.

Referring now to FIG. 6, the third embodiment of my sighter's protective helmet is adapted to protect the wearer against injury from bumps or the like, as well as from injury resulting from ballistic objects. This form of my invention includes a two-piece outer rigid shell including a rear piece 176 having a pair of adjustable webbing tabs 178, one of which is shown in FIG. 6, secured to the lower forward portion of the piece 176 by any suitable means such as bolts or the like.

Each of the tabs 178 carries a snap fastener element 180 adapted to engage a complementary snap fastener element 124 carried by the left or right leather piece 80 of the inner helmet 10. Preferably, I provide the inner forward central portion of the rear shell part 176 with a pad 181 of pin and loop fastener elements adapted to cooperate with the fastener elements on the pad 96 on the inner helmet 10. The rear shell part 176 also carries a snap fastener element 182 adapted to be engaged by the fastener element 102 carried by the tab 100 on the inner helmet securely to hold the rear outer shell part 176 in place on the inner helmet.

The form of my sighter's protective helmet illustrated in FIG. 6 includes a removable hard outer shell forehead piece 184. Adhered to the inner surface of this hard outer shell portion is a relatively thin piece of stiff plastic 186 to the inner surface of which there are adhered bodies 188 of bump resistant material similar to that of which the inserts 36, 38, 40 and 42 are formed. The upper end of the plastic piece 186 extends beyond the parting line between the forehead piece 184 and main piece 176 of the outer shell 174 to form a lip 190. I secure one end of each of a pair of adjustable elastic straps 192 to the separable forehead portion 184 of the hard outer shell by means of screws 194. The other end of each of the straps 192 carries a snap fastener element 196 which engages a complementary fastener element carried by the rear shell part 176 at a location above one of the earcup assemblies 56 or 58.

I form the parting line between the shell parts 176 and 184 at the sides thereof with steps 198 which aid in locating the separable forehead piece 184 on the piece 176 when the part 184 is brought into operative position.

Both the rear part 176 and the removable forehead part 184 making up the rigid ballistic outer shell may be formed of any suitable material providing ballistic protection. For example, each of them may be formed as an assembly of inner and outer shells of polycarbonate resin carrying a coating of a suitable elastomer with a layer of fibers Kevlar or Nomex sandwiched in between. Kevlar and Nomex are trademarks of the E.I. Du Pont De Nemours and Co. for high elongation, high tensile strength fibrous material having a high melting point, including aromatic polyimide resins. The fibrous material making up the laminates of the inner layer may be woven or may be needlepoint felt or may be fibrous material loosely bound together by any suitable binder.

Figure 7:
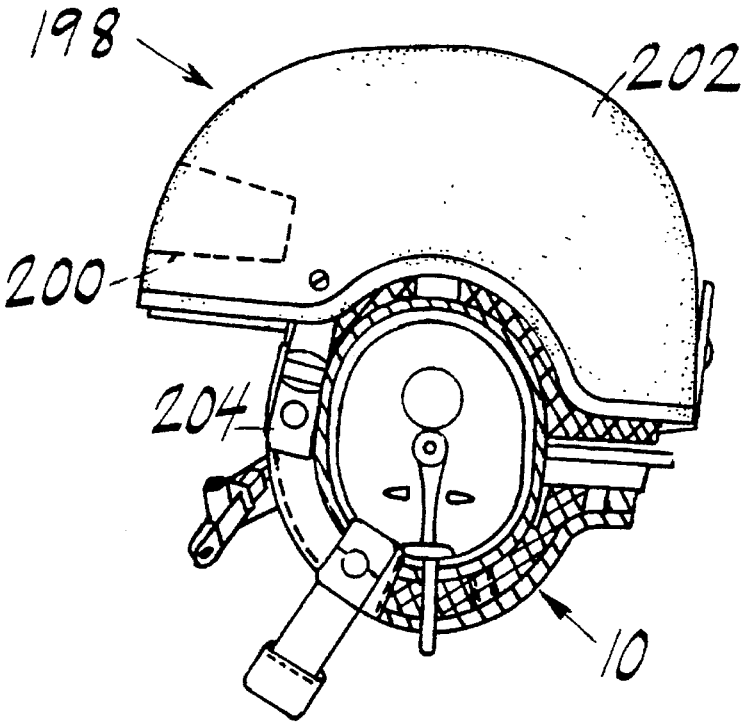
FIG. 7 is a side elevation of a complete assembly of a fourth embodiment of my sighter's protective helmet assembly.

Referring now to FIG. 7, yet another embodiment of my sighter's protective helmet indicated generally by the reference character 198 includes the inner helmet 10 and a unitary hard outer shell 202 formed of the same ballistic material as are members 176 and 184 to afford the wearer ballistic protection. A pad 200 of bump resistant material similar to that of which the insert 130 is formed is adhered or otherwise secured to the inner surface of the shell 202 in the forehead region thereof. Preferably it is in the same configuration as the pad 188 so as to afford the wearer full protection against injury from bumps, as well as ballistic protection, when the shell 202 is in place on the inner helmet 10. Shell 202 is provided with a pair of straps 204 similar to the straps 178 to attach the outer shell to the inner helmet 10. In addition, the rear of the shell 202 has a snap fastener element adapted to receive the element 102 on the strap 100. Both the shell 202 and the helmet 10 may be provided with interengageable pin and loop fasteners, as desired, for holding the shell in position on the helmet 10.

It will be appreciated that the fourth embodiment of my protective helmet assembly, like the second embodiment thereof, is intended for use by personnel having little or no occasion to use a sighting device. Again, it renders the inner helmet 10 suitable for all persons.

In use of all forms of my sighter's protective helmet assembly, the wearer first dons the inner helmet 10. In so doing, the ends of the crown strap 82 which pass through the loops 86 and 92, first are pulled until the helmet 10 is snug on the wearer's head. This operation is assisted by adjusting the nape strap 74. These two adjustments permit one size helmet 10 to fit all wearers. In addition, the crown strap positions the earcup assemblies 56 and 58 directly over the wearer's ears.

If the user of the helmet is not concerned with ballistic protection but only with protection against injury from bumps, he may elect to use either the embodiment of my protective helmet assembly shown in FIGS. 3 and 4 or that shown in FIG. 5. If he is required to use a sighting device relatively frequently, he would choose the form of my helmet assembly shown in FIGS. 3 and 4. In so doing, he first assembles the cover 104 on the inner helmet 10. In so doing, the flap 114 is wrapped around the member 66 and secured to itself by means of the fastener elements 116. The snap fastener elements 122 are snapped onto the elements 124 of the inner helmet 10. Fastener element 102 is snapped onto element 118 and the cover 104 then is securely held onto the inner helmet 10.

To complete this embodiment of my sighter's protective helmet assembly, the removable piece 126 is assembled onto the cover 104 over the fabric 70 of the inner helmet. This is achieved by bringing the fastener elements carried by the pads 140, 142 and 144 into engagement with complementary fastener elements on the cover 104, such as the elements on the pad 146 which cooperates with pad 144. The wearer is then fully protected against head injuries from bumps and the like. When the wearer is required to use a sighting device, he merely removes the piece 126. When that has been done, only the two thin fabric layers 70 and 72 cover the forehead of the wearer and he can bring his eye into close proximity to the sighting device. When he has finished using the sighting device, he replaces the piece 126 in the manner described above. If desired, pin and loop fasteners may be provided to retain the removed piece 126 on the cover 104 at the rear thereof.

A person who has little or no occasion to use a sighting device might select the form of my invention illustrated in FIG. 5. In this instance, the cover 148 is assembled on the inner helmet 10 in the same manner as has been described hereinabove in connection with cover 104. When that has been done, the insert 170 overlies the forehead of the wearer so that he is fully protected against injury from bumps. When the wearer is required to use a sighting device, the brow portion of the cover 148 carrying insert 170 can be stowed on the rear part of the inner helmet 10 in the manner described above.

Where ballistic protection as well as bump protection is desired by an individual who is required to use a sighting device relatively frequently, he would select the form of my protective helmet illustrated in FIG. 6. The hard outer shell 174 is assembled on the inner helmet 10 by snapping the fastener elements 180 into engagement with the elements 124 on the inner helmet and by snapping fastener element 102 on the tab 100 carried by the inner helmet into engagement with the fastener element 182 on the hard outer shell part 176. The head of the wearer is then protected both against injury from bumps and against injury from ballistic missiles.

When a person wearing the form of my protective helmet shown in FIG. 6 is required to use a sighting device, he manually moves the piece 184 from the full line position illustrated in FIG. 6 to the dot-dash line position shown therein. When that has been done, the wearer's forehead is covered only by the thin fabric layers 70 and 72 so that the wearer's eye can be brought into close proximity to the sighting device.

It will be appreciated that the elasticity of the straps 192 assists in maintaining the piece 184 in the dot-dash line position of FIG. 6 while the wearer is using a sighting device. When the wearer has finished using the sighting device and wishes to restore full bump and ballistic object protection, he moves the piece 184 from the dot-dash line position shown in FIG. 6 to the full line position shown therein. It will readily be appreciated that restoration of piece 184 accurately to its full line position is facilitated by the lip 190 which slides under the portion of the shell part 176 above the parting line between parts 176 and 184 and by the shoulders 198 formed along the parting line.

A person who has little or no occasion to use a sighting device and who desires both ballistic and bump protection would choose the form of my protective helmet assembly illustrated in FIG. 7. In use of that form of the invention, the hard outer ballistic shell 198 normally is assembled on the inner helmet 10 in the manner described above with the pad 200 of bump protecting material overlying the fabric layer 70 of the inner helmet. When the person wearing this form of my protective helmet assembly must use a sighting device, the unitary outer shell 202 must be removed.

It will be seen that I have accomplished the objects of my invention. I have provided a protective helmet assembly which is especially adapted for use by sighters. It protects the sighter's head against injury from bumps or both bumps and ballistic objects. It permits a sighter to position his eye close to the sighting device without sacrificing all of the protection afforded by the assembly. The inner helmet thereof accommodates all head sizes.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A headgear assembly for protecting the head of a wearer against injury from bumps including in combination a flexible helmet adapted to fit closely to the wearer's head, said helmet having a frontal portion extending over the wearer's forehead and a second portion extending rearwardly from said frontal portion to the nape of the wearer's neck, impact-resistant energy-absorbing material of relatively great thickness carried by said helmet second portion, a separable body of impact-resistant energy-absorbing material of a thickness comparable to that carried by said helmet second portion and means for removably positioning said separable body over said frontal portion of said flexible helmet to protect the forehead of the wearer against injury from bumps, the frontal portion of the flexible helmet being relatively thin compared with the impact-resistant energy-absorbing material of the separable body.

2. A headgear assembly as in claim 1 in which said means for removably positioning said separable body over said frontal portion comprises a cover for said second portion of said helmet, means for detachably securing said cover to said helmet and means for detachably securing said separable body to said cover.

3. A headgear assembly as in claim 2 in which said means for detachably securing said separable body to said cover comprises an envelope containing said body, rearwardly extending tabs on said envelope and interengageable fastener elements on said tabs and on said cover.

4. A headgear assembly as in claim 3 in which said means for detachably securing said cover to said helmet comprises a pair of downwardly extending side tabs at the front of said cover, interengageable fastener elements on said side tabs and said helmet, a rear tab on said helmet and interengageable fastener elements on said rear tab and on said cover.

5. A headgear assembly as in claim 2 including earcup assemblies carried by said helmet and a wire form biasing said earcup assemblies toward the wearer's ears, said wire form having a portion extending around the back of said helmet, said cover having a rear flap, said flap adapted to be folded inwardly over said wire form portion and means for retaining said flap in said folded condition.

6. A headgear assembly as in claim 2 in which said material carried by said second helmet portion is tapered along its front edge, said separable body being tapered along its upper edge, said tapered edges overlying each other when said separable body is positioned over the frontal portion of said helmet.

7. A headgear assembly as in claim 2 wherein said cover comprises a first rigid ballistic shell, further including a second rigid ballistic shell adapted to overlie the second portion of the flexible helmet.

8. A headgear assembly as in claim 1 in which said means for removably positioning said separable body over said frontal portion comprises a cover adapted to extend over said frontal portion and said second portion of said helmet, said cover formed with a frontal envelope enclosing said separable body and means for detachably securing said cover to said helmet with said envelope overlying said frontal portion.

9. A headgear assembly as in claim 8 in which said detachable securing means comprises releasable fastener means, said assembly comprising means operable with said fastener means released for retaining said cover frontal envelope and the separable body carried thereby in a stowed position on said helmet away from said frontal portion of said helmet.

10. A headgear assembly as in claim 9 in which said cover retaining means comprises an elastic strap extending between said cover frontal envelope and said helmet.

11. A headgear assembly as in claim 1 including a two-piece ballistic shell carried by said helmet, said shell comprising a front part overlying said frontal portion of said helmet and a second part adapted to overlie the second portion of the helmet, said means for removably positioning said separable body over the frontal portion of the helmet comprising means for securing said second shell part to said helmet, means for securing said separable body to said front part of said shell and means mounting said front part of said shell on the second part of the shell for movement between a position overlying the helmet frontal portion to a position displaced therefrom.

12. A headgear assembly as in claim 11 in which said front part of said shell is provided with a lip to assist in locating said front shell part on said second shell part.

13. A headgear assembly as in claim 12 in which said front and second parts of said shell are separable along a parting line, said parting line being formed with a shoulder to assist in locating said front shell part on said second shell part.

14. A headgear assembly as in claim 13 in which said means mounting said front shell part on said second shell part comprises an elastic strap.

15. A headgear assembly as in claim 11 in which said means mounting said front shell part on said second shell part comprises a pair of elastic straps extending between the respective sides of said front shell part and corresponding sides of the second shell part.

16. A headgear assembly as in claim 1 in which said means for removably positioning said separable body over the frontal portion of the helmet comprises a one-piece ballistic shell adapted to cover the frontal and second parts of the helmet, means for securing said separable body to the portion of said shell adapted to cover said frontal portion and means for detachably mounting said shell on said helmet.

* * * * *